United States Patent [19]

Arakawa

[11] 4,362,190

[45] Dec. 7, 1982

[54] METHOD OF SENSING ABNORMALITY OF WEFT DETECTING DEVICE IN LOOM

[75] Inventor: Akio Arakawa, Kariya, Japan

[73] Assignee: Kabushiki Kaisha Toyoda Jidoshokki Seisakusho, Aichi, Japan

[21] Appl. No.: 202,764

[22] Filed: Oct. 31, 1980

[30] Foreign Application Priority Data

Nov. 7, 1979 [JP] Japan ..... 54-144647

[51] Int. Cl.[3] ..... D03D 51/34

[52] U.S. Cl. ..... 139/370.2; 139/353; 139/336; 66/163

[58] Field of Search ..... 139/336 R, 353, 370.1, 139/370.2, 273 R; 340/259, 501, 506, 677; 66/163

[56] References Cited

U.S. PATENT DOCUMENTS 3,608,590 9/1971 Hohener ..... 139/370.2
3,863,241 1/1975 Kamiyamaguchi et al. ..... 66/163
4,023,599 5/1977 Zeleny ..... 139/370.2
4,051,871 10/1977 Vella ..... 139/370.2
4,178,590 12/1979 Weidmann ..... 340/506
4,295,499 10/1981 Suzuki et al. ..... 139/370.2

*Primary Examiner*—Henry Jaudon
*Attorney, Agent, or Firm*—Wenderoth, Lind & Ponack

[57] ABSTRACT

Disclosed is a method of sensing an abnormality in a weft detecting device which is employed in a loom in order to detect whether a weft is present in a predetermined interval corresponding to a set crank angle range within one revolution of the crank. When the weft detecting device generates a signal in the predetermined crank angle range excluding the weft detection angle range, the signal is regarded as an abnormal signal. The abnormal signal is processed by circuitry to detect the abnormality in the weft detecting device. Thus, when it is impossible to detect a weft insertion error because of some abnormality in the weft detecting device, the presence of the abnormal signal is utilized to issue an alarm or to stop the operation of the loom.

4 Claims, 6 Drawing Figures

METHOD OF SENSING ABNORMALITY OF WEFT DETECTING DEVICE IN LOOM

BACKGROUND OF THE INVENTION

This invention relates to a method of sensing abnormalities of a weft detecting device employed in a loom.

Ordinarily, the position in which a weft is detected by a weft feeler, namely the crank angle phase during one revolution of a loom, is approximately constant for each revolution even though there may be some degree of variance, the crank phase angle being limited to within a certain crank angle range. Accordingly, the effect of extaneous signals other than weft signals for a fabric or the like can be excluded to enhance reliability by restricting, to a suitable range which includes the aforementioned crank angle range, the range over which the weft feeler performs the operation of detecting weft insertion errors. This relationship is expressed by the diagram of FIG. 1. Specifically, no detection signal $S_2$ indicative of a weft insertion error is generated when a weft detection signal $S_1$ is detected in a weft detection angle range $A_1$ where the range of the crank angle is constant, but the detection signal $S_2$ indicative of a weft insertion error is generated when no weft detection signal $S_1$ is detected in the range $A_1$. Thus, reliability is enhanced since the detection operation is not performed even if extraneous signals occur outside of the weft detection angle range $A_1$.

It should be noted, however, that a large quantity of extraneous signals $S_o$ (which are taken as being pulsed signals similar to the weft detection signals $S_1$) are generated if flies or yarn waste attach to the detection portion of the weft feeler, if the mounting of the detection portion loosens, if a wire is about to break and makes intermittent contact, or if extraneous noise is received. If these extraneous signals $S_o$ occur also in the weft detection angle range $A_1$, as shown in FIG. 2, a weft insertion error cannot be detected owing to the signal $S_o$, even though the weft (the weft detection signals $S_1$) is not detected. The disadvantageous result is that a void appears in the woven fabric.

SUMMARY OF THE INVENTION

Accordingly, it is an object of the present invention to provide an abnormality sensing method of a weft detecting device for use in a loom, which makes it possible to prevent voids in a woven fabric by effectively discovering when detection of a weft insertion error is impossible owing to flies or yarn waste attaching to the weft detection portion, or the generation of the extraneous signal due to a partially broken or poorly connected wire, extraneous noise or a poor ground, etc.

With this object in view, this invention provides an abnormality sensing method of a weft detecting device for use in a loom wherein, when an extraneous signal is generated in a predetermined crank angle range excluding the weft detection angle range of a weft detecting device which generates a signal upon detecting wefts for each single weft insertion operation, an abnormal detection signal is generated by regarding the extraneous signal as an abnormal signal, thereby making it possible to prevent the voids in the woven fabric.

BRIEF DESCRIPTION OF THE DRAWINGS

Other features and advantages of the present invention will be apparent from the following description taken in conjunction with the accompanying drawings, wherein.

DESCRIPTION OF THE PREFERRED EMBODIMENT

The operating principle of the present invention will now be set forth with reference to FIGS. 3 and 4.

The position (crank angle $\alpha$) in which a weft is detected by a weft detecting portion is decided for each revolution of the crank as described above and, as illustrated in FIG. 3, is restricted to a certain range $A_1$. Accordingly, when the weft detection device is operating normally, no signals are generated in the range $A_2$ which is outside of the range $A_1$. If flies or the like attach to the weft detecting portion, however, extraneous signals $S_o$ are generated as a result. These signals $S_o$ ordinarily appear irregularly, as shown in FIG. 4, and occur in both the range $A_1$ and the range $A_2$.

When extraneous signals $S_o$ other than the weft signals appear in the weft detection angle range $A_1$, a weft feeler cannot detect a weft insertion error since the extraneous signal $S_o$ is processed in the same manner as a weft detection signal $S_1$, even through a weft insertion error has occurred. It is difficult to distinguish directly between the weft detection signal $S_1$ and an extraneous signal $S_o$ in the range $A_1$. However, extraneous signals $S_o$ are generated also in the other range $A_2$ as described above owing to the attaching flies, although no signals should appear in this range during normal operation. Hence, the extraneous signals $S_o$ in the range $A_2$ can immediately be regarded as abnormal signals. Furthermore, signals which are generated owing to yarn waste attaching to the weft detecting portion, extraneous noise, poor circuit ground or partial wire disconnection or breakage, also appear in both the ranges $A_1$ and $A_2$ in the same manner as when the flies attach to the detecting portion.

The present invention has been deviced by utilizing the fact that the extraneous signals $S_o$ appear also in the range $A_2$, which signals are generated when flies or the like attach to the weft detecting portion. In accordance with the principle of the present invention, an abnormality detection signal $S_3$ is generated, as shown in FIG. 4, when an extraneous signal $S_o$ is present in the range $A_2$, thereby permitting the detection of an abnormality in the weft detecting device, that is, a condition in which the detection of a weft insertion error is not possible. The abnormality detection signal $S_3$ is employed to actuate an alarm display or to stop the loom, thereby preventing an unsatisfactory weft insertion error detection operation so that the resulting void in the woven fabric is effectively prevented.

Figure 1:
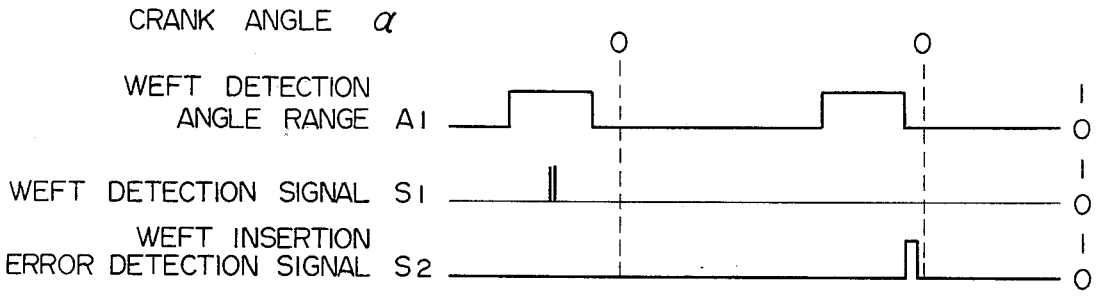
FIG. 1 is a waveform diagram which is useful in describing a method of detecting a weft insertion error in connection with a weft detecting device used in a loom in accordance with the prior art.
Figure 2:
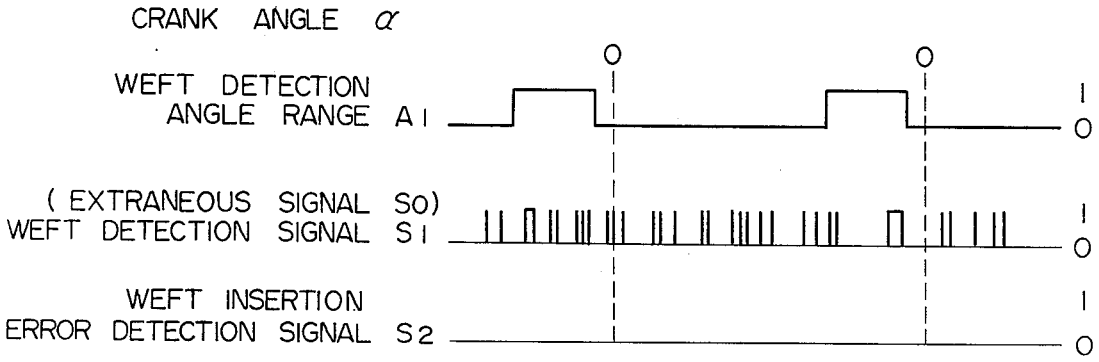
FIG. 2 is a waveform diagram illustrating a case in which detection of a weft insertion error is impossible owing to generation of extraneous signals due to flies or yarn waste or the like attaching to the weft detecting device of FIG. 1.
Figure 3:
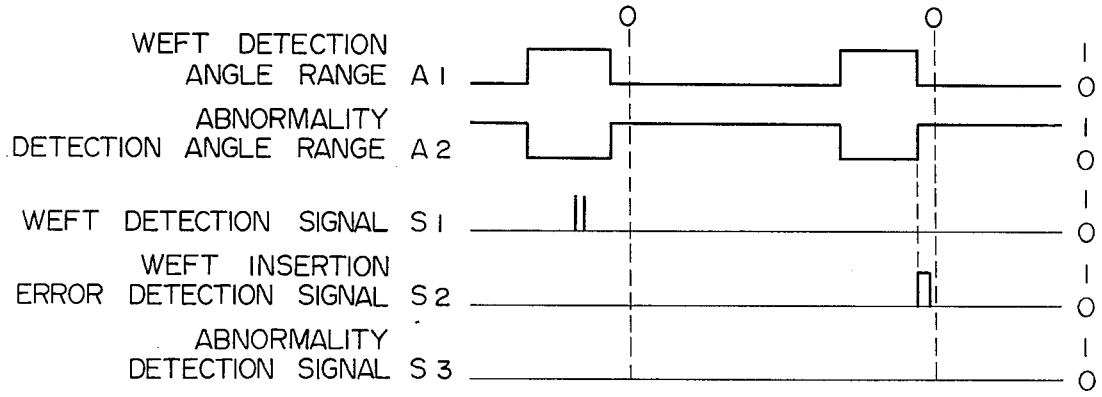
FIG. 3 is a waveform diagram of a normal condition and is useful in describing the operating principle of an abnormality sensing method in a weft detecting device in accordance with the present invention.
Figure 4:
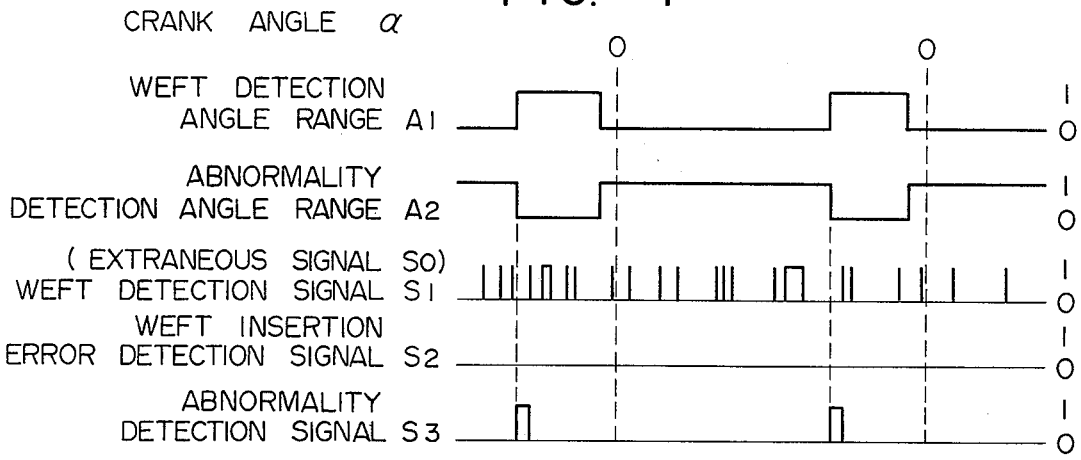
FIG. 4 is a waveform diagram of an abnormal condition and is useful in describing the operating principle of an abnormality sensing method in a weft detecting device in accordance with the present invention.
Figure 5:
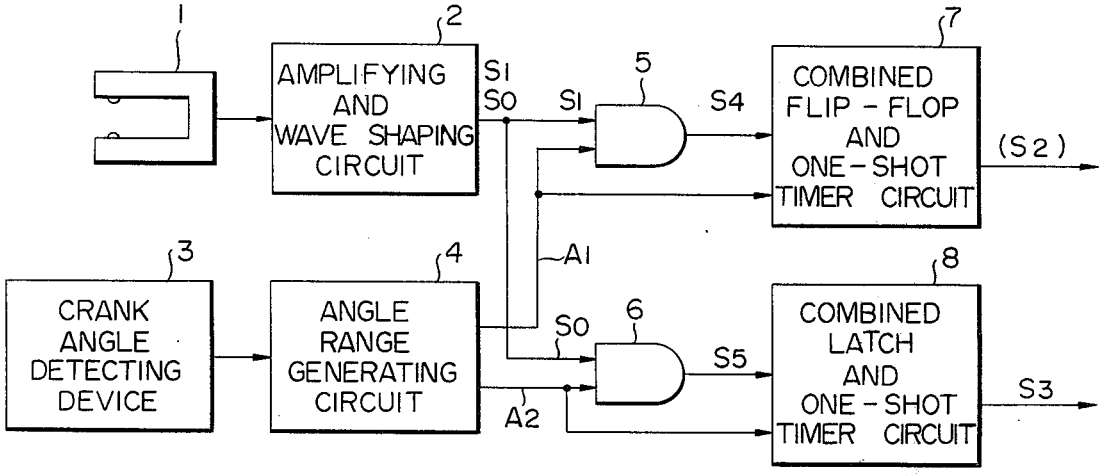
FIG. 5 is a circuit diagram showing an abnormality sensing device of a weft detecting device.

Reference will now be had to FIG. 5 to describe an abnormality sensing circuit of a weft detecting device, which circuit is adapted to execute the fundamental operation of the present invention as illustrated in FIGS. 3 and 4. The weft detecting device may include, for example, a photoelectric detector 1 having a phototransistor and a light-emitting diode (LED) arranged in an opposing relationship. A weft crossing the optical axis of the photoelectric detector 1 causes the detector to generate a signal which is applied to an amplifying and wave shaping circuit 2 connected to the detector, the circuit 2 responding by delivering a weft detection signal $S_1$ (extraneous signal $S_o$), as illustrated in FIG. 3.

A photoelectric-type rotary encoder may be employed as a crank angle detector 3 for detecting the crank angle $\alpha$. Connected to the output of the crank angle detector 3 is an angular range generating circuit 4 which receives the output of the detector 3 in the form of a suitable code, such as a binary number, which represents the crank angle $\alpha$. The circuit 4 is adapted to compare the output of the detector 3 and a preset numerical value, and to generate angle range signals shown in FIG. 4, namely the weft detection angle range signal $A_1$, and a signal $A_2$ (abnormality detection angle range signal) other than the signal $A_1$. Two AND gates 5, 6 are connected to the amplifying and wave shaping circuit 2 and the angle range generating circuit 4. The AND gate 5 produces the signal $S_4$ when it receives the weft detection angle range signal $A_1$ from the angle range generating circuit 4 and the weft detection signal $S_1$ from the amplifying and wave shaping circuit 2. The AND gate 6 produces the signal $S_5$ when it receives the abnormality detection angle range signal $A_2$ from the angle range generating circuit 4 and the extraneous signal $S_o$ from the amplifying and wave shaping circuit 2. A combined flip-flop and one-shot timer circuit 7 is connected to the AND gate 5 and angle range generating circuit 4. When the signal $S_4$ (logical "1") is applied to the combined circuit 7, the logical "1" is stored. The arrival of the trailing edge of the signal $A_1$ under these conditions clears the logical "1", so that the combined circuit 7 cannot deliver the detection signal $S_2$ which is indicative of the weft insertion error. Conversely, the combined circuit 7 is adapted to produce the detection signal $S_2$, consisting of a one-shot pulse, when the trailing edge of the signal $A_1$ arrives under a condition where the logical "1" is not stored in the combined circuit 7. This condition arises when the weft detecting device does not detect a weft, thus preventing the AND gate 5 from applying the signal $S_4$ to the combined circuit 7.

A combined latch and one-shot timer circuit 8 is connected to the AND gate 6 and the angle range generating circuit 4. The combined circuit 8 is adapted to receive and store the signal $S_5$ (logical "1") provided by the AND gate 6 when it receives the abnormality detection range signal $A_2$ and the extraneous signal $S_o$. When the trailing edge of the signal $A_2$ arrives under these conditions, the combined circuit 8 delivers the abnormality detection signal $S_3$ consisting of a one-shot pulse. Therefore, when an extraneous signal $S_o$ is generated during the signal $A_2$, the abnormality detection signal $S_3$ is produced to issue an alarm or to stop the loom, thereby to assure the detection of a weft insertion error and, in effect, the resulting void in the woven fabric.

Thus, in accordance with the present embodiment of the invention, an extraneous signal $S_o$, when it occurs in the range $A_2$ other than the weft detection angle range $A_1$, is regarded as an abnormal signal which is detected by the AND gate 6, the AND gate 6 producing the signal $S_5$ which is applied to, and stored in, the combined latch and one-shot timer circuit 8. When the trailing edge of the signal $A_2$ arrives under these conditions, the combined circuit 8 is adapted to produce the abnormality detection signal $S_3$. Thus, a simple method of detecting the absence or presence of a signal in the range $A_2$ permits the detection of various abnormalities in a weft detecting device in a highly effective manner. For example, it is possible to detect the attaching of flies on the detecting portion, the entangling of yarn waste, extraneous noise, poor grounding, partial wire disconnection or breakage, or looseness of the detecting mounting, etc.

Furthermore, in accordance with the present embodiment of the invention, the arrangement in such that the abnormality detection signal $S_3$ is produced by regarding as an abnormal signal the extraneous signal $S_o$ which occurs in the range $A_2$ other than the weft detection angle range $A_1$. This makes it possible to ascertain a sensitivity maladjustment, and to readily adjust the sensitivity, since the extraneous signal $S_o$ will appear and the abnormality detection operation will be executed also in a case where the sensitivity of the photoelectric detector 1 is set too high.

The present invention can also be embodied in the following ways.

Figure 6:
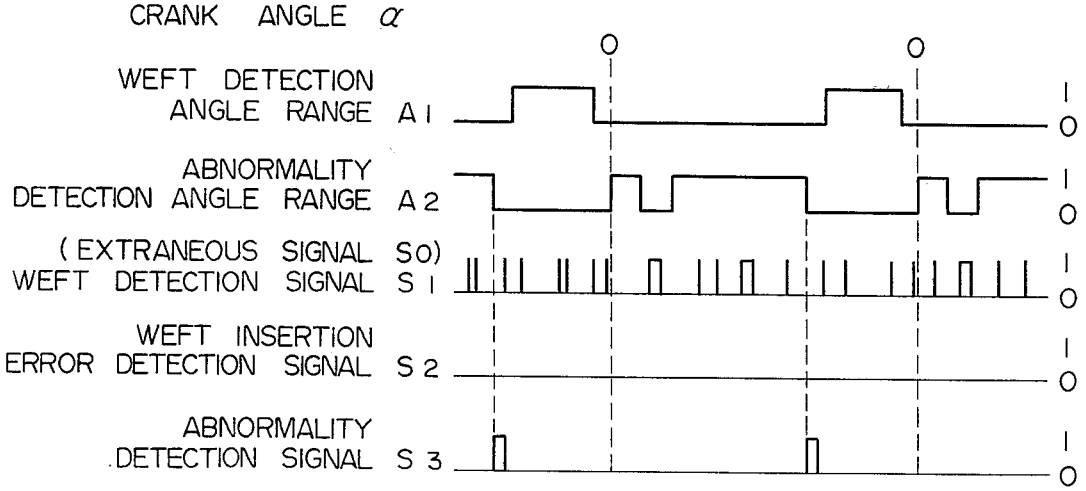
FIG. 6 is a waveform diagram which is useful in describing the operating principle of another method of setting an abnormal detection angle range.

(1) A constant angle included within the crank angle, extending the weft detection angle range $A_1$, can be set as the abnormality detection angle range $A_2$, as shown in FIG. 6. This can be performed for a case where a signal is inevitably generated in a fixed interval, within the abnormality detection angle range $A_2$, by means of a weft insertion carrier for a fabric or rapier loom or the like or by another mechanism provided on the loom, or even in a case where this phenomenon does not occur.

(2) While the abnormality detection signal $S_3$ is shown as being generated as a one-shot pulse at the trailing edge of the abnormality detection angle range signal $A_2$, any crank angle position will suffice. Moreover, the signal $S_3$ may be a stepped signal if desired.

(3) It is possible to adopt an arrangement in which a single generation of the abnormality detection signal $S_3$ is not immediately regarded as an abnormality. In other words, an abnormality would be judged to have occured only in the following three cases:

(a) when the abnormality detection signal $S_3$ is generated continuously for a prescribed number of loom revolutions;

(b) when the abnormality detection signal $S_3$ is generated 20 times or more, by way of example, during a prescribed number of loom revolutions, such as 100 revolutions;

(c) when a suitable combination of (a) and (b) occurs, such as when either (a) or (b) occurs, or when (a) and (b) occur continuously in a prescribed number of loom revolutions.

Adopting the foregoing arrangement makes it possible to prevent the abnormality detection operation resulting from the temporary attaching of flies or from transient extraneous noise, etc.

(4) It is possible to count the weft detection signals $S_1$ that are generated in the abnormality detection angle range $A_2$, and to consider it an abnormality when the number of counted signals exceeds a certain fixed number.

(5) It is possible to change the fixed numbers, used in considering the conditions (a), (b) and (c) in (3) above as abnormalities, depending upon the number of extraneous signals $S_o$ counted in the abnormality detection angle range $A_2$.

As described in detail above, the present invention finds application in a loom wherein a predetermined crank angle range is set within one revolution of the crank, the loom having a weft detecting device for detecting the presence of a weft within the set interval. When the weft detecting device issues a signal in the predetermined crank angle range excluding the weft detection angle range, this signal is regarded as a abnormal signal to enable the detection of the abnormality in the weft detecting device. As a result, when it is not possible to detect a weft insertion error because of flies or yarn waste attaching to the weft detecting portion, this condition can be discovered effectively to prevent voids in the woven fabric. Moreover, these voids can also be prevented when it is impossible to detect the weft insertion error due to partially broken or disconnected wires, extraneous noise or poor grounding or the like. This is accomplished by discovering such condition as described above.

What I claim is:

1. In a loom equiped with a weft detecting device for setting a predetermined crank angle range within one revolution of the crank and for detecting the presence of a weft within the set interval, a method of sensing an abnormality in the weft detecting device of said loom, which comprises the steps of regarding, as an abnormal signal, a signal which is generated by the weft detecting device within a predetermined crank angle range excluding the weft detection angle range, and detecting an abnormality in the weft detecting device on the basis of the abnormal signal.

2. The method according to claim 1 wherein, when the signal generated in the predetermined crank angle range excluding the weft detection angle range is generated continuously throughout at least a predetermined number of revolutions of the loom, said signal is regarded as the abnormal signal.

3. The method according to claim 1 wherein, when the signal generated in the predetermined crank angle range excluding the weft detection angle range is generated in excess of a preset ratio during a predetermined number of loom revolutions, said signal is regarded as the abnormal signal only when the abobe condition holds.

4. The method according to claim 1 wherein, either when the signal generated in the predetermined crank angle range excluding the weft detection angle range is generated continuously throughout at least a predetermined number of revolutions of the loom, or when the signal is generated in excess of a preset ratio during a predetermined number of loom revolutions in the same range, said signal is regarded as the abnormal signal only when either of the above operations occurs continuously in a fixed number of revolutions of the loom.

* * * * *